United States Patent [19]

Koch

[11] 4,285,559

[45] Aug. 25, 1981

[54] COMBINING DRAWERS

[76] Inventor: George B. Koch, 711 Meadowsweet #109, Corte Madera, Calif. 94925

[21] Appl. No.: 102,206

[22] Filed: Dec. 10, 1979

[51] Int. Cl.[3] ..... A47B 47/00

[52] U.S. Cl. ..... 312/298; 312/107; 312/111; 312/303; 312/330 R

[58] Field of Search ..... 312/107, 108, 111, 242, 312/263, 298, 303, 330

[56] References Cited

U.S. PATENT DOCUMENTS

| | | | |
|---|---|---|---|
| 386,492 | 7/1888 | Penberthy | 312/303 |
| 2,506,844 | 5/1950 | Smith | 312/107 |
| 2,511,949 | 6/1950 | Simon | 312/107 |
| 3,012,762 | 12/1961 | Norris | 312/107 |
| 3,339,994 | 9/1967 | Reddig et al. | 312/303 |
| 3,552,817 | 1/1971 | Marcolongo | 312/107 |
| 3,901,572 | 8/1975 | Litchfield | 312/111 |

*Primary Examiner*—Casmir A. Nunberg
*Attorney, Agent, or Firm*—Townsend and Townsend

[57] ABSTRACT

The invention provides overlapping drawers, such as those used in desks, bureaus and the like, with attachment apparatus for joining an upper drawer to an immediately underlying drawer in vertically registered alignment. The bottom panel of the upper drawer is removable so that the joined drawers operate as one large drawer.

10 Claims, 5 Drawing Figures

COMBINING DRAWERS

This invention relates to sliding drawers of the type usually held in relative vertical registration to one another in desks, bureaus and the like, and particularly to drawers which can be operably joined to one another to create one deep drawer from two or more shallow drawers.

BACKGROUND OF THE INVENTION

Drawers are a well-traveled art. Typically in the form of sliding, rectangular, box-like structures, they are slidably held in desks, bureaus, credenzas, chests of drawers, and the like in relative vertical registered alignment. One common characteristic drawers generally share is that once they are made, their overall dimensions, particularly their capacity for holding objects, is not easily alterable. This characteristic is unfortunate, for often, with the passage of time, requirements or needs change. For example, when one purchases a desk, the purchaser may have, at that time, required only one deep drawer and one or more shallow drawers. Subsequent to the desk's purchase, the requirement may have changed to more deeper drawers and fewer shallow drawers. The approach to this problem has heretofore generally been threefold: (1) Make due with the desk as is, (2) modify the desk's structure, or (3) buy a new desk that meets these new requirements.

Similarly, the converse of the above problem can be encountered. A chest of drawers, for example, containing a small number of vertically registered, high-capacity (i.e., deep) drawers may have been purchased with specific requirements or a particular use in mind. Yet, as time goes by, it is often found that new requirements or additional uses call for a greater number of lower-capacity (i.e., shallow) drawers. In such a case, one is once again left with the three above-stated approaches.

SUMMARY OF THE INVENTION

The present invention provides a fourth approach to these long-endured problems, an approach that is inexpensive, practical and easy to implement. The invention provides structure that allows two or more separate, registered drawers to be joined in vertical alignment so that they operate as a single, large drawer.

According to the present invention, at least two drawers, one superposed over the other, are slidably held in a support structure—a desk, for example. Each drawer includes an article-receiving enclosure formed from a surrounding sidewall structure having front, side and back panels. A bottom panel of at least the superposed one of two drawers is removably supported within the sidewall structure, proximate one periphery thereof, by a sill that is attached to each side panel.

In one embodiment of the invention the apparatus for attaching one drawer to an immediately underlying drawer is as follows: Affixed to at least each rear corner of the lower drawer, and adjacent the upper periphery, is a corner block having formed therein a vertically oriented aperture therethrough. The rear portion of each sill of the lower drawer is provided with a vertical aperture situated so that the aperture can be placed coaxial with that of the corresponding corner block of the underlying drawer when the two drawers are placed in vertically registered relation. An attachment pin is provided, configured and of a length to be easily received by and extend between the two coaxially aligned apertures formed in the sills and corner blocks of two vertically registered drawers, to join the drawers together.

In use, two or more drawers of the present invention are conventionally mounted in such support structure as desks, credenzas, bureaus or the like. The bottom panel can then be removed from the upper of the two drawers and the attachment pins inserted through the sill apertures of the upper drawer and into the underlying apertures in the corner blocks of the underlying drawer. With the pins so inserted, and the bottom panel removed from the upper drawer, the two drawers are operatively joined to form a single drawer having a combined holding capacity of the two drawers. If desired, three or more drawers can be joined to form a single drawer of even greater holding capacity.

An object of the invention is to provide a vertically registered grouping of drawers the ability to have two or more drawers combined into one deeper drawer or be used as separate, relatively shallow drawers. This provides the owner with the ability to tailor the size of the drawers to meet changing needs and requirements. If a deep file drawer is no longer needed, the drawers may be separated, the bottoms reinserted, and the owner quickly has the needed shallow drawers. Likewise, a chest of drawers for clothes may be converted from shallow drawers for baby clothes to deeper drawers for sweaters and other bulky clothing. Another advantage accrues from the reduced costs which result. The manufacturer needs to make fewer different-sized drawers and the wholesaler and retailer need to stock fewer types of units.

Additional objects and features of the invention will appear from the following description in which the preferred embodiment has been set forth in detail in conjunction with the accompanying drawings.

DETAILED DESCRIPTION OF THE INVENTION

Figure 1:
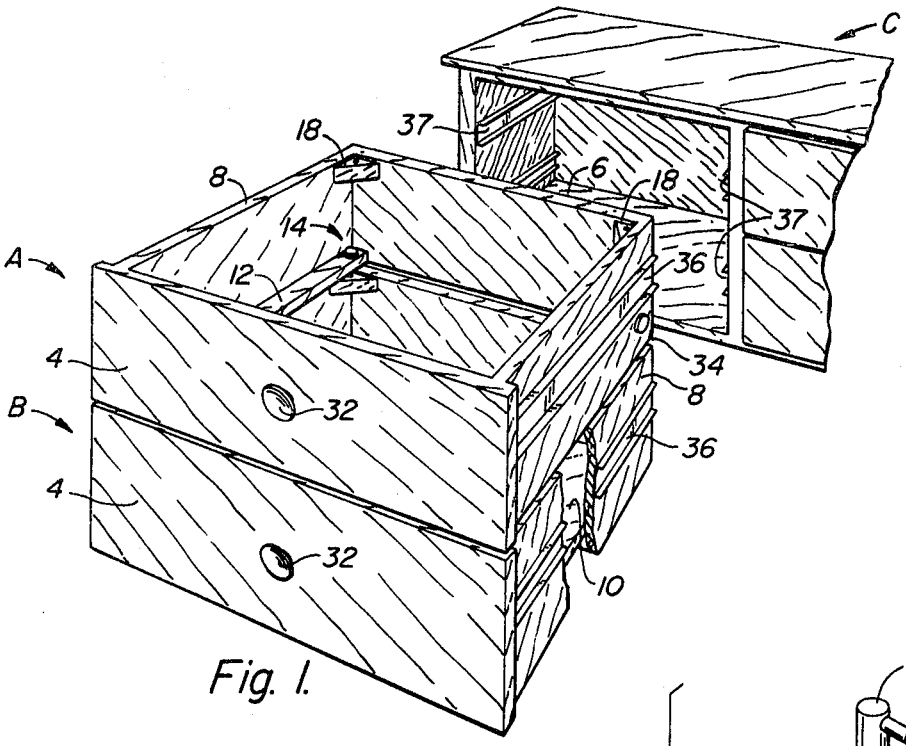
FIG. 1 is a perspective view of a portion of a support structure that holds two vertically aligned drawers of the present invention and illustrates combination of the drawers to form one deep drawer.
Figure 2:
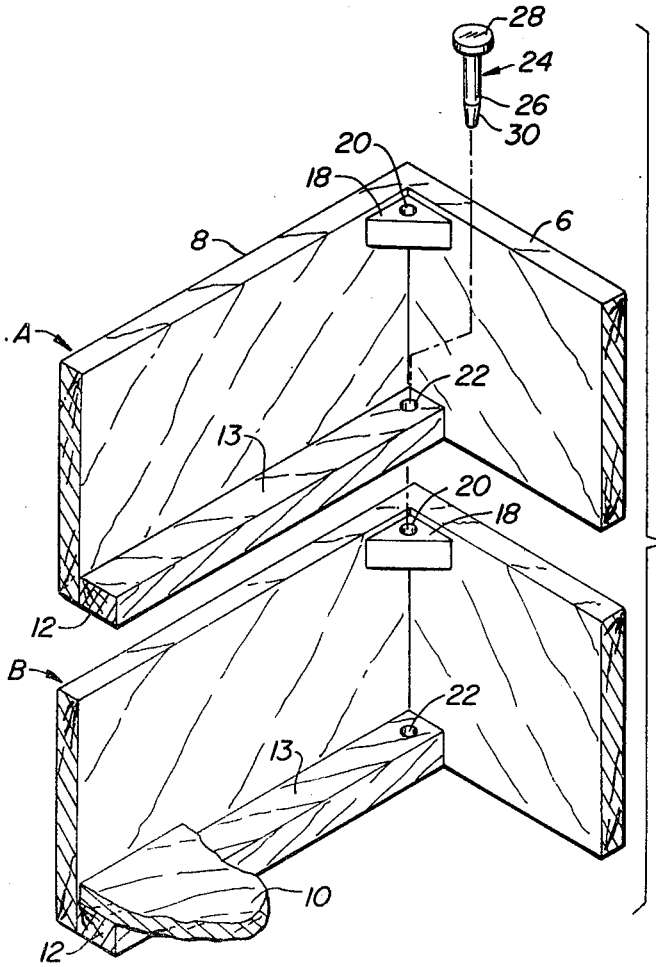
FIG. 2 is a detailed sectional view of the back and side panels of two separated but vertically aligned drawers showing one embodiment of the attachment apparatus.

Turning now to the drawings, there are illustrated drawers A and B, constructed in accordance with the present invention and, as illustrated in FIG. 1, slidably held in a support structure C (e.g., a desk). The drawers A and B are identically structured and, therefore, only drawer A will be described. It will be understood, however, that the description of the parts and numbering of drawer A will apply equally to the structure and parts of the drawer B. As seen in FIG. 1, drawer A includes a front or face panel 4, a back panel 6 and two spaced, parallel side panels 8 extending between the front and back panels 4 and 6, respectively, forming the familiar rectangular drawer sidewall structure. A planar bottom panel 10 is configured to be removably received and held within the drawer A, supported therein by a pair of spaced, parallel sills 12 that are attached to and run along the bottom peripheries of the side panels 8. As can be more particularly seen in FIG. 2, the sills 12 present an upper surface 13 for supporting the bottom panel 10 when inserted in the drawer A.

Near the upper corner peripheries formed by the junctions of back panel 6 and side panels 8 and 8, there is fixedly attached a triangularly shaped corner block 18. Formed in each corner block 18 is a vertically oriented through-hole 20. A similarly dimensioned through-hole 22 is formed in each sill 12. The through-hole 22 is located so as to be substantially coaxial with the overlying through-hole 20 in the corner block 18 when the two drawers A and B are situated in vertically registered alignment as illustrated in FIG. 1.

A lock pin 24 is provided having an elongate, cylindrically shaped shaft 26, a disc-like head 28 affixed at one end of the shaft 26. The opposing end 30 is provided with a frustoconical shape for purposes which will become evident as explained below. The shaft 26 of the pin 24 is dimensioned to be freely and easily received by the apertures 20 and 22 formed in the corner block 18 and sill 12, respectively. Further, the length of the shaft 24, as will be more particularly described below, is of a dimension that will allow the pin 24 to be inserted in the hole 22 formed in a sill 12 of drawer A, for example, and extend therethrough into the hole 20 of an underlying corner block 18 of drawer B.

The Figures illustrate the drawer A to be constructed of wood. However, it should be evident to those skilled in the art that a variety of other suitable materials, such as metal, plastic or the like, can also be used to construct the drawers of the present invention.

The practical aspects of the drawers of the present invention are realized when at least two of the drawers are slidably held in appropriately formed support structure C in vertically registered relation such as, for example, found in bureaus, chests of drawers and desks. At least two overlying, vertically registered drawers constructed in accordance with the present invention are needed. Further, any type of support structure can be used to support and allow the drawer to be slidably withdrawn from the support structure C. The support structure C preferably holds the drawers for slidable movement in a horizontal plane so that each drawer held therein can individually be withdrawn from the support structure C when one pulls on the knob 32 affixed to the outer facing of the front panels 4.

While the support structure C can be provided with any appropriate holding apparatus for slidably holding the drawers A and B therein, it is preferred that the holding apparatus used be of a type that minimizes the spacing 34 (FIG. 1) between two vertically registered drawers when so held. Thus, it is suggested that the drawers A and B be mounted within the support structure C using conventional side rail mounting. One such method of mounting drawers A and B is illustrated in FIG. 1 in which runners 36 are affixed to the outer surface of the outside panels 8 of drawers A and B. Side rails 37 are attached to the support structure C for receiving and supporting the drawers A and function to cooperatively engage the runners 36 to allow slidable movement of the drawers within the support structure C.

With drawers A and B slidably held in an appropriately constructed support structure C, use of the invention can now be described. The drawers A and B can first be used individually. In this respect, both drawers A and B would have their respective removable bottom panels 10 inserted therein and supported by the sills 12. However, when the need arises to combine the drawers A and B to form one single, deeper drawer of greater holding capacity, the bottom panel 10 of the overlying or upper drawer A is removed. The drawers A and B are then aligned to make coaxial the apertures 22, formed in the sills 12 of drawer A, with the underlying aperture 20, formed in the corner blocks 18 of drawer B. (It will be appreciated that drawers A and B should be withdrawn a sufficient distance from the support structure C to allow the bottom panel 10 to be removed from drawer A and provide access to apertures in which pin 24 is to be inserted.) So aligned, the fastening pin 24 can then be inserted into and through the aperture 22 formed in each sill 12 of the drawer A and into the underlying aperture 20 of the drawer B. Thereby, the drawers A and B are joined so that sliding movement of one of the drawers in the support structure, drawer A for example, will effect like movement of the underlying drawer, drawer B. By operatively combining the two drawers A and B, a single drawer is obtained with a holding capacity of the combination.

The tapered or frustoconical-shaped end 30 of the shaft 26 of the fastening pin 24 acts to compensate for slight misalignments of the apertures 22 and 20. In this respect, also, it may be desired to counterbore the top portion of the underlying hole 20, formed in the corner block 18, to accommodate the disc-like head 28 of the fastening pin. This allows a convenient receptacle for the fastening pin when the combining aspects of the invention are not in use (i.e., when the drawers are each provided with their respective bottom panels 10 and used individually).

It should be noted that the invention, thus described, is illustrated and described as using only two corner blocks 18 (with apertures 20 formed therein) and two apertures 22 formed in each sill 12. It will be readily evident to those skilled in the art, however, that corner blocks 18, each having formed therein apertures 20, could be alternately placed at the intersection of side panels 8 and front panel 4. Further, a corner block 18 could be placed at each one of the four intersections of side panels 8 with front and rear panels 4 and 6, provided that drawer A is of sufficient depth to angularly provide sufficient clearance for the bottom panel 10 to bypass corner blocks 18 and insertion or removal of the bottom panel 10.

An alternate method of joining drawers A and B together, similar to that described above, is illustrated in FIG. 3. In place of sill 12 there is provided, at the two rear corners of the drawer A, proximate the junction of the side panels 8 and rear panel 6, a bracket 38. Bracket 38 is provided with wing-like flanges 39 and is fastened to the interior surface of side panels 8 via any appropriate fastening apparatus such as, for example, screws 40 which extend through appropriately formed apertures in the wing sections 39 of the bracket 38. The bracket 38 is provided with a planar support surface 42 and a vertically oriented, cylindrical throughbore 44. The support surface 42 has formed therein detent slots 46 and 48. The bracket 38 functions to provide a four-point support for the bottom panel 10 (there being a bracket 38 proximate each corner formed by the junction of side panels 8 and rear panel 6 of drawer A). The remaining support, a front sill (not shown) similar in structure to sill 12, extends along the lower periphery of front panel 4 to provide an upper surface defining, with the support surface 42, a support plane that can be used to support the bottom panel 10.

Figure 3:
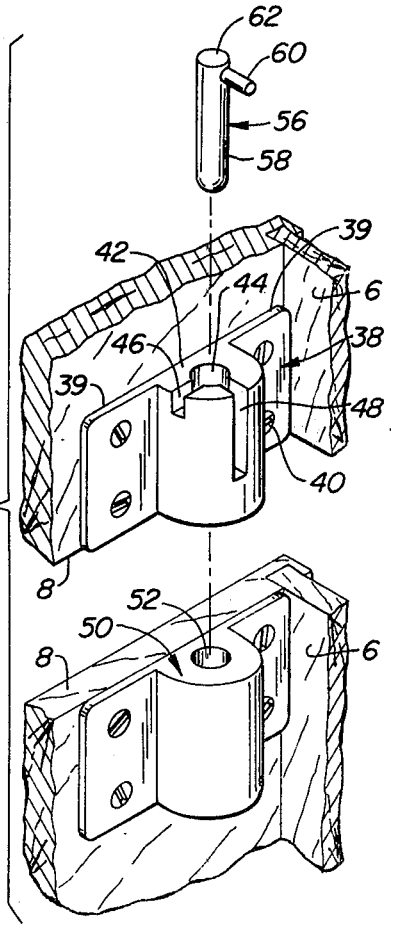
FIGS. 3–5 illustrate alternative attachment apparatus.

Affixed to the side panels 8 proximate the upper periphery of the junctions between the rear panel 6 and the side panels 8 is another bracket 50. Bracket 50 is essentially identical in structure to bracket 38 with the exception of the absence of detent slots 46 and 48 affixed via fastening apparatus. Bracket 50 is located on the drawer so that a vertically disposed throughbore 52 formed therein can be placed in coaxial relation with the aperture 44 of an overlying bracket 38 when two drawers constructed in accordance with this disclosure are placed in vertically registered relation. A fastening pin 56 is shaped and configured to be inserted into and through the throughbores 44 and 52 of the brackets 38 and 50, respectively. The fastening pin 56 has a cylindrically shaped body portion 58 and a finger element extending radially therefrom and located at one of the opposing ends of the shaft 58. The opposing end of the shaft may be provided with a frustoconical configuration, such as that provided the fastening pin 24 of FIG. 2, or alternatively, with a somewhat hemispherical shape as illustrated in FIG. 3. The purpose of so configuring the end of the shaft 56 is for the reasons stated above with respect to the fastening pin 24: To allow the fastening pin 56 to be inserted into the throughbores 44 and 52 notwithstanding minor misalignments between them.

In use as individual drawers, the fastening pin 56 is held within the throughbore 44, the arm 60 being situated in the retaining slot 46. The depth of retaining slot 46, relative to the location of arm 60, allows the head surface 62 of the fastening pin 56 to be situated flush or perhaps a little below the support surface 42 of bracket 38. In this way, the fastening pin does not interfere with the support function of the bracket 38 when the bottom panel 10 is supported by the bracket 38 in the drawer. When the upper drawer A is to be combined with a lower drawer B, the lower panel 10 is removed from the upper drawer A. As described above, both drawers are partially withdrawn from the support structure (not shown) to allow one access to the fastening pin contained in the bracket 38 of the upper drawer A. The drawers A and B are vertically registered so that the apertures 44 formed in the brackets 38 of the overlying drawer A are made substantially coaxial with the throughbores 52 formed in the brackets 50 of the underlying drawer B. The fastening pin may then be grasped by its arm 60, raised from the retaining slot 46, turned 90 degrees and allowed to drop into the deeper locking slot 48. This allows the shaft 58 of the fastening pin to be inserted in and received by the underlying throughbore 52 of bracket 50, fastened to the underlying drawer B. In this way, the two drawers now are joined together to function as a single, higher capacity drawer.

Figure 4:
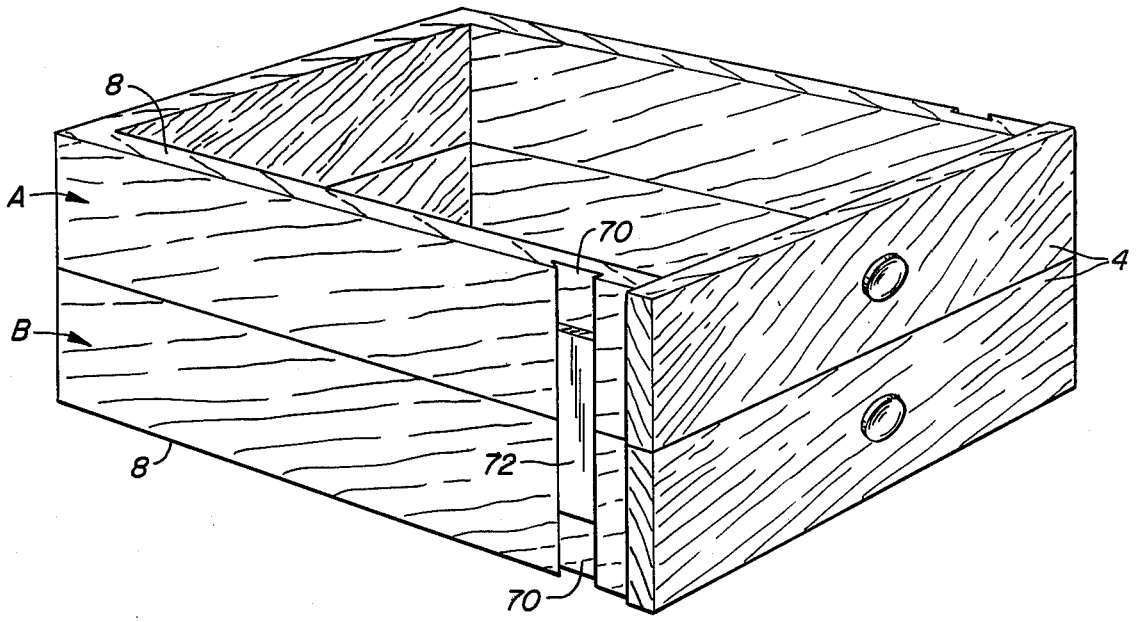

FIG. 4 illustrates yet another alternate embodiment of the attachment apparatus of the present invention. As shown, a dovetail channel 70 is formed in one or more of the vertical, outer surfaces of the drawers A and B. Here, the channel 70 is shown formed in a side panel 8 of the drawers. When the two drawers A and B are to be combined, they are registered, as illustrated in FIG. 4, so that the dovetail channels 70 formed in the side panels 8 of the respective drawers are longitudinally aligned. It should be apparent that the dovetail channels 70 are formed in the side panels 8 so that when drawers A and B are vertically registered, the respective dovetail channels 70 are likewise aligned.

With the dovetail channels 70 so aligned as described and illustrated, a slat 72, formed and configured to be slidably received by the dovetail channel 70, is inserted in one of the dovetail channels. The slat 72 is positioned within the dovetail channels 70 of both drawers A and B, thereby joining the two drawers. The bottom panel 10 (not shown in FIG. 4) can then be removed from drawer A and the combination of the two drawers A, B used as one single drawer.

Figure 5:
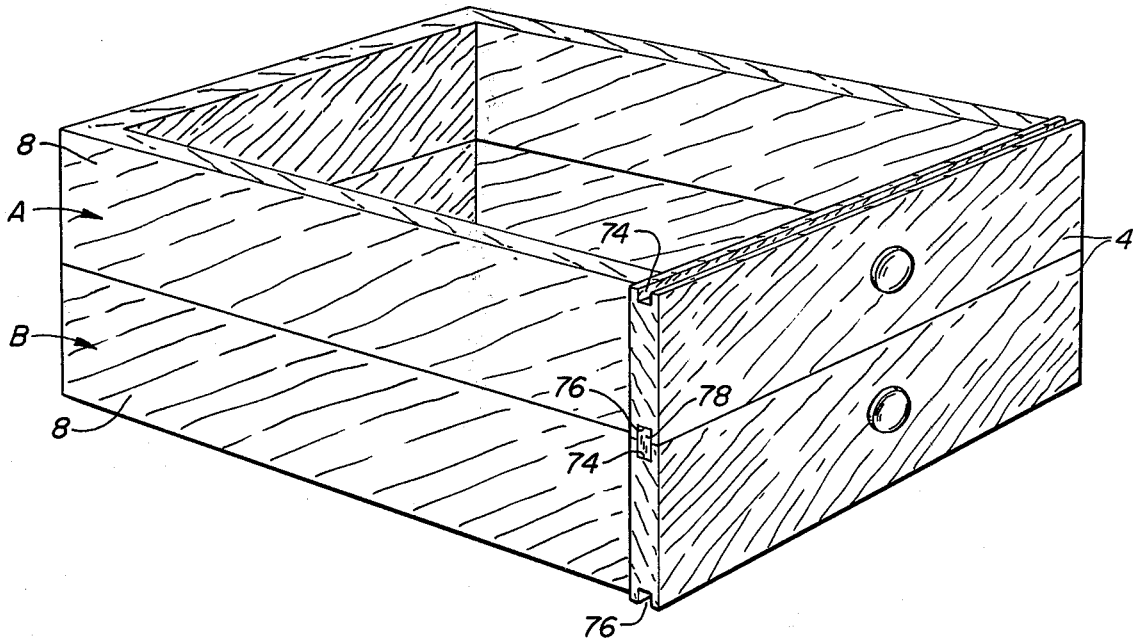

The drawers A and B shown in FIG. 5 illustrate a method of joining the two drawers using grooves 74 and 76 respectively formed in the top and bottom peripheries of front panels 4. The grooves 74 and 76 are situated so as to be placed in confronting relation (i.e., the groove 74 of drawer B confronts groove 76 of drawer A) when the drawers A and B are vertically registered. So situated, a rib 78, configured to be slidably received by the hollow formed by the confronting grooves 74 and 76 of drawers B and A, respectively, is inserted in the grooves. The rib 78 is dimensioned to extend substantially the entire length of the grooves 74 and 76 (which themselves extend the full longitudinal length of the side panels 4), yet not protrude from the hollow when appropriately located therein—as illustrated in FIG. 5.

Of course, it should be evident that the invention need not be limited to the use of only two vertically registered drawers constructed as described above. To the contrary, a plurality of drawers can be held in an appropriately constructed support structure and used as desired to form one or more deeper drawers from a greater number of shallower drawers.

While the above provides a full and complete disclosure of the preferred and alternate embodiments of the invention, various modifications, alternate constructions and equivalents may be employed without departing from the true spirit and scope of the invention. For example, the bottom panel 10 need not be removable, but could be structured to form the device used to combine the two drawers, as follows: The bottom panel 10 would be split along a line running down the center of the panel, parallel to the side panels 8, from the front panel 4 to the back panel 6, forming two substantially equally-dimensioned half-panels. Each half-panel would be hingedly attached to its respective side panel 8 so that the half-panels of a superposed drawer (i.e., drawer A) could swing into and be received by the underlying drawer (i.e., drawer B). Thereby, the bottom panel of the overlying drawer is, in effect, removed and the two drawers are joined as one. When the two drawers are to be separably operable, a releasable hook-type latch or hooking apparatus can be used to attach and hold the two half-panels in a planar relation to each other, forming the bottom panel 10 of the overlying drawer.

Therefore, the above description and illustrations should not be construed as limiting the scope of the invention, which is defined by the appended claims.

What is claimed is:

1. At least a pair of first drawers adapted to be held by a support structure in vertically registered, adjoining relation and to be joined together to effectively form a second drawer having a holding capacity substantially equal to the sum of the holding capacities of the first drawers, each of said first drawers being slidably mounted in said support structure for individual movement when not joined together and united movement when joined together, each of said first drawers comprising:

a generally rectangular sidewall structure including a front panel, a back panel and a pair of side panels, said front, back and side panels having substantially identical transverse dimensions;

a bottom panel configured and dimensioned to be situated to extend between opposing surfaces of the sidewall structure with the front, back and side panels extending vertically upward from the bottom panel when the drawer is held by the support structure, at least the upper one of the first drawers including means for allowing the bottom panel to be removable; and means for releasably joining said first drawers to one another in vertically registered alignment so that slidable movement of one of the first drawers will effect like movement in the other of the drawers.

2. The invention of claim 1, wherein the upper one of said first drawers includes an elongate sill member mounted to each opposing surface of the side panels and proximate a longitudinal periphery thereof, the bottom panel being dimensioned and configured to be placed in said sidewall structure and removably supported by said sill members.

3. The invention of claim 1, wherein the joining means includes a first portion formed in the upper one of the first drawers having an aperture formed therein, a second portion of the lower one of the first drawers having an aperture formed therein, the first and second portions being relatively situated to make coaxial their respective apertures when the first drawers are in vertically registered alignment, and a connecting pin configured to be received by said apertures and dimensioned to be retained by and extend through the aperture of the first portion and be received by the aperture of the second portion when said apertures are coaxial.

4. The invention of claim 1, wherein the upper one of said first drawers includes a pair of parallel sill elements affixed to opposing surfaces of the sidewall structure for removably supporting the bottom panel therein, at least one of the sills having formed therein a first aperture, the lower one of the first drawers including a portion having formed therein a second aperture adapted to be situated in coaxial relation with the first aperture when the first drawers are in relative, vertically registered alignment, and an elongate connecting pin being configured, dimensioned, and adapted to be inserted in, retained by, and extend through the first aperture and into the second aperture when the first and second apertures are placed in coaxial relation.

5. The invention of claim 1, wherein the joining means includes a channel transversely formed in the outer surface of the sidewall structure of the first drawers and situated to be longitudinally aligned when said first drawers are placed in superposed relation, and a slat element formed and configured to be removably received by said channel, said slat being dimensioned and adapted to extend between the longitudinal channels of said first drawers.

6. The invention of claim 1, wherein the joining means includes a first groove formed in the upper one of said first drawers, a second groove formed in the underlying one of said first drawers, the first and second grooves being relatively located to be placed in confronting relation to form a hollow when said first drawers are verticaly registered, and a rib element formed and configured to be received by said hollow and engage and join said first drawers.

7. The invention of claim 6, wherein said first and second grooves are formed in end peripheries of said front panels of said first drawers.

8. The invention of claim 6, wherein said first and second grooves are rectangular in section.

9. The invention of claim 1, wherein the joining means includes drawer structure affixed to said first drawers, said drawer structure each having an aperture formed therein, said drawer structure being situated on the corresponding first drawers to place said apertures in relative coaxial relation when said first drawers are vertically registered; and a holding pin adapted to be inserted in and held by said coaxially aligned apertures.

10. Combinable drawer apparatus, comprising:

a support structure;

at least first and second drawer structures, each drawer structure including a bottom panel and a sidewall panel coupled to and surrounding the bottom panel forming an article-receiving recess, at least the first drawer structure including means for allowing the bottom panel to be removable therefrom;

means for mounting the first and second drawer structures to the support structure in vertically registered and adjacent relation with the first drawer structure overlying the second drawer structure, the mounting means including means for allowing the first and second drawer structures to be movable relative to the support structure; and means affixed to the first and second drawer structures for releasably joining the first drawer structure to the second drawer structure in adjoining superposed, registered relation, the support structure being configured to allow joint movement of said joined first and second drawer structures so that when joined the bottom panel of the first drawer structure can be removed and the joined first and second drawer structures form, and operate as, a single drawer having an article-receiving cavity substantially equal to the combination of the article-receiving recess of the first and second drawer structures.

* * * * *